US007832678B2

(12) United States Patent
Hjort et al.

(10) Patent No.: US 7,832,678 B2
(45) Date of Patent: Nov. 16, 2010

(54) DISPENSER FOR ROLLS

(75) Inventors: Erik Hjort, Sater (SE); Stig Pommer, Hedemora (SE); Per Moller, Leksand (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 12/307,012

(22) PCT Filed: Jul. 7, 2006

(86) PCT No.: PCT/SE2006/000857

§ 371 (c)(1),
(2), (4) Date: Dec. 30, 2008

(87) PCT Pub. No.: WO2008/004920

PCT Pub. Date: Jan. 10, 2008

(65) Prior Publication Data

US 2009/0308966 A1 Dec. 17, 2009

(51) Int. Cl.
*B65H 19/00* (2006.01)

(52) U.S. Cl. ..... 242/560.3; 242/559.3

(58) Field of Classification Search ..... 242/558, 242/559, 559.1, 559.3, 559.4, 560, 560.1, 242/560.2, 560.3, 561
See application file for complete search history.

(56) References Cited

U.S. PATENT DOCUMENTS 2,767,930 A * 10/1956 McCants ..... 242/560.3
3,572,602 A * 3/1971 Mott et al. ..... 242/560.3
3,620,466 A 11/1971 Bump
3,770,222 A 11/1973 Jespersen
3,771,739 A 11/1973 Nelson
3,948,454 A 4/1976 Bastian
4,756,485 A 7/1988 Bastian et al.

(Continued)

FOREIGN PATENT DOCUMENTS

CH 247416 3/1947

(Continued)

OTHER PUBLICATIONS

International Search Report dated Feb. 6, 2007, in PCT application.

(Continued)

*Primary Examiner*—William A Rivera
(74) *Attorney, Agent, or Firm*—Young & Thompson

(57) ABSTRACT

A dispenser for rolls of web-shaped material, includes a housing having at its bottom part an outlet opening for the web-shaped material and a space for at least two rolls arranged substantially horizontally. A first part of the space is located adjacent the outlet opening and is intended for a first roll in a dispensing position and a second part of the space includes a locking element intended to keep the second roll in standby position. The first part is provided with holding elements for keeping the first roll in use position, the holding elements are spring-loaded and cooperate with the locking elements such that when a roll is located in the first space the locking element prevent the standby roll from falling down, but when the first roll is released from the first space the locking element release and permits the standby roll to occupy the dispensing position.

19 Claims, 10 Drawing Sheets

U.S. PATENT DOCUMENTS

| | | | | |
|---|---|---|---|---|
| 4,844,361 | A * | 7/1989 | Granger | 242/561 |
| 4,944,466 | A * | 7/1990 | Jespersen | 242/560.3 |
| 5,558,302 | A * | 9/1996 | Jesperson | 242/560 |
| 5,628,474 | A * | 5/1997 | Krueger et al. | 242/560 |
| 6,082,664 | A * | 7/2000 | Phelps et al. | 242/560 |
| 6,752,349 | B2 | 6/2004 | Moody et al. | |
| 7,338,007 | B2 * | 3/2008 | Valot | 242/560 |
| 2008/0078855 | A1 | 4/2008 | Forman | |

FOREIGN PATENT DOCUMENTS

| | | | |
|---|---|---|---|
| EP | 0758539 | A1 | 2/1997 |
| RU | 2110944 | C1 | 5/1998 |
| WO | 2007111544 | | 10/2007 |

OTHER PUBLICATIONS

Decision on Grant in Corresponding Application No. 2009104065 dated Mar. 23, 2010.

* cited by examiner

DISPENSER FOR ROLLS

TECHNICAL FIELD

The present invention relates to a dispenser for rolls of web-shaped material, such as paper and non-woven sheets, said dispenser comprising a housing having at its bottom part an outlet opening for the web-shaped material and a space for at least two rolls. A first part of the space is located adjacent the outlet opening and is intended for a first roll in a dispensing, or use position and a second part of the space comprises a locking means intended to keep the second roll in standby position. The first part is provided with holding means for keeping the first roll in use position, said holding means is spring-loaded and cooperates with the locking means in such a way that when a roll is located in place in the first space the locking means prevents the standby roll from falling down, but when the first roll is released from the first space the locking means will be released and permit the standby roll to fall down to the dispensing position in the first space. Simultaneously, the first roll is displaced into a stub roll position.

BACKGROUND ART

Dispensers with automatic roll change are well known. In operation, automatic dispensers often require rolls with a divided core that has to break into two sections as the roll is exhausted and fall out of the dispenser, before the roll change take place. Although a large number of alternative prior art solutions are available, their function and reliability may be affected by a number of inherent problems typical for this type of dispenser.

U.S. Pat. No. 3,770,222 shows a dispenser comprising means for supporting a first roll having spindle means extending axially outwardly beyond the ends thereof in a dispensing position from which flexible sheet material may be withdrawn. The supporting means is operable to move the spindle means of the first roll from a first position when the first roll is full to a second position when the first roll is substantially exhausted. Further means is provided for releasably holding a second roll in a reserve position above the dispensing position and consisting of at least one pivotally mounted lever member extending from the dispensing position to the reserve position, said lever member being engageable with the spindle means of the first roll and operative to sense the position thereof, said lever member being further operative to hold the second roll in the reserve position while said first roll spindle means moves from said first position to said second position and to automatically release the second roll from the reserve position when said first roll spindle means has moved to said second position; and means for guiding the second roll from the reserve position to the dispensing position when the lever member releases the second roll.

One problem with this solution is the difficulty of determining when a roll is substantially exhausted. If the roll is removed before it is exhausted, paper is wasted unnecessarily. On the other hand, the roll must be removed before it is completely exhausted. The latter case may lead to a further problem, wherein a roll that becomes exhausted before it has moved to its second position may remain in or near the dispensing position. This would effectively block the second roll from being moved into the dispensing position. A further problem relates to the friction between the roll support in the dispenser and the spindles or adaptors supporting the roll. In order to ensure that the roll is easily removed from the dispensing position the friction forces should be relatively low, but at the same time the friction forces must be sufficient to prevent excessive amounts of paper from being dispensed if the roll is pulled relatively hard.

The basic problem for dispensers of this type in general is that the automatic roll change is dependent on several different things occurring more or less at the same time. A number of factors can influence the function of a dispenser of this type. For instance, friction forces between roll and dispenser, based on roll size and contact surface, must be reduced below a predetermined limit to allow displacement of the roll. The rotating roll is influenced by forces caused by paper pull or gravity and should be moved out of position before a release mechanism is allowed to release a new roll from a resting position. During these operations the paper shall be completely or substantially exhausted. In many cases something goes wrong here and the automatic roll change is interrupted.

The above problems are solved by an improved dispenser with automatic roll change according to the invention. The dispenser solves the problem relating to the timing of the roll change when the roll is substantially exhausted and provides an improved mechanism for releasing the exhausted roll and replacing it with a reserve roll.

DISCLOSURE OF INVENTION

This object of the invention is achieved by a method for dispensing rolls according to the invention and a dispenser for carrying out the method, having the characteristic features defined in the appended claims.

According to a preferred embodiment, the invention relates to a method for dispensing rolls of flexible sheet material, each of said rolls having spindle means extending axially outwardly beyond the ends thereof. The spindle means may comprise any suitable type of plug or adapter inserted into or adhesively attached to the ends of a roll core, a coreless roll or a solid roll. The pairs of plugs or adapters may be individual units or be joined through the centre of a roll. The spindle means may be displaced between a first position, where the outer ends of the spindles are flush with the end surfaces of the roll to facilitate packaging and transport, and a second, extended position, where the spindles may cooperate with guide slots and catches in a roll dispenser. This type of spindle means is described in the international patent application no. PCT/SE2006/050043 which is hereby incorporated by reference. However, the dispenser according to the invention may also use spindles having fixed outer ends, providing that the shape of said ends may cooperate with the said guide slots and catches. In the dispenser, a first roll is in located in a dispensing position and a second roll is located in a reserve position above said dispensing position. In the subsequent text, the term "dispensing position" is the position where a major part of the paper or web is dispensed from a roll. Similarly, the term "stub roll position" is the position where the remaining, minor part of the paper or web is dispensed. The method may comprise the steps of:

- sensing the diameter of the first roll by means of at least one first sensor means in contact with an end surface of the roll,
- triggering said at least one first sensor means when the diameter is below a predetermined value, whereby the first sensor means is displaced past the plane of the end surface,
- releasing at least one first catch holding the first roll in place, said at least one first catch being released by the displacement of the said at least one first sensor means,
- allowing the first roll to move out of the dispensing position for subsequent actuation of at least one second sensor means, releasing at least one second catch holding the second roll in the reserve position, said at least one second catch being released by the movement of the first roll out of the dispensing position, allowing the second roll to move from the reserve position into the dispensing position.

The method may involve holding the at least one first sensor means in contact with an end surface of the first roll by pivoting a section of the first sensor means into contact with said end surface of the roll.

According to one example, the at least one first sensor means may be held in contact with an end surface of the roll by using resilient means, such as an elastomeric material or a spring. A similar resilient means may be provided acting on the at least one first catch, which cooperates with one or both spindle means to hold the first roll in the dispensing position. According to a further example, the resilient means acting on the at least one first catch may also act on the at least one first sensor means. When triggered, the first sensor may be pivoted and/or moved axially at right angles relative to the plane of the end surface of the wound web making up the roll.

After triggering the first sensor means the first roll will move out of the dispensing position and subsequently actuate the said at least one second sensor means. When the first roll has moved past the first sensor means the second sensor means may be displaced by an end surface of the first roll or its spindle means, thereby releasing the second catch and moving the second catch out of contact with the second roll. The second sensor may be moved out of contact with the end surface of the second roll and/or the spindle means of the second roll. Alternatively the second catch may support a tangential outer surface of the second roll directly. In the latter case the second catch is moved out of contact with the outer surface of the second roll. This allows the second roll to move from the reserve position downwards to the dispensing position.

When the first roll is moved out of the dispensing position, past the first and second sensors, it is allowed to move into a stub roll position in which the last part of the paper or web may be removed by a user.

The invention also relates to a dispenser for carrying out the above method. The dispenser contains one or more rolls of flexible sheet material, each of said rolls having spindle means extending axially outwardly beyond the ends thereof, wherein a first roll is located in a dispensing position and a second roll is located in a reserve position above said dispensing position. The rolls may preferably, but not necessarily, be placed in the dispenser with their axes at substantially right angles to a rear surface of a wall mounted dispenser. This roll arrangement also allows relatively large diameter rolls to be placed in a dispenser while extending a relatively small distance from the wall. The reason for this is that while roll sizes will increase with increasing diameters, the width of the rolls remains substantially the same for the same type of web to be dispensed.

According to a preferred embodiment, the dispenser comprises at least one first sensor means arranged for sensing the diameter of the first roll wherein at least one first sensor means is in contact with an end surface of the roll, and that said at least one first sensor means is displaceable between a first position in contact with said end surface and a second position past the plane of the end surface when the diameter of the roll is below a predetermined value. A part of the first sensor means is in contact with the end surface of the wound web section of the first roll at a predetermined radial position thereof. When the roll is exhausted to a predetermined degree, the sensor means is no longer supported by the end surface of the roll and will move past the plane of the end surface. The contacting part of the first sensor means may then be located in a position between the plane of the end surface and a vertical plane through the centre of the first roll.

The dispenser further comprises at least one first catch holding the first roll in place. Such a first catch is preferably, but not necessarily, placed in contact with the spindle means located on both sides of the first roll, releasably supporting the rotatable first roll in the dispensing position. The at least one first catch is arranged to be released by the displacement of the said at least one first sensor means. The first roll may then move out of the dispensing position under the influence of gravity or by a force caused by a user pulling out a section of the web.

When the first roll is displaced out of the dispensing position at least one second sensor means may be displaced between a first position and a second position. The displacement may be caused by a spring load acting on the second sensor when at least one spindle means and/or an end surface of the first roll is moved out of contact with the second sensor means. The second sensor means is directly or indirectly connected to at least one second catch holding the second roll in place in the reserve position. The second catch is arranged to be released by the displacement of the said at least one second sensor means.

According to one embodiment, the at least one first sensor means is mounted on a pivot joint substantially parallel to an end surface of the first roll. The said first sensor means may be provided with a guide slot allowing the spindle means extending out of the end surfaces of the roll to pass the first sensor means This arrangement allows a roll to move from the reserve position and at least partially past the first sensor means into contact with the first catch in the dispensing position.

When a first roll is located in the dispensing position a section of the at least one first sensor means remote from the pivot joint is arranged to be pivoted into contact with said end surface. In this position, the main portion of the first sensor means is located substantially parallel to, or at a relatively small angle relative to the plane of the end surface of the adjacent first roll. In order to hold each first sensor means in contact with said end surface of the first roll the at least one first sensor means is provided with resilient means arranged to act directly or indirectly on the first sensor.

Similarly, the at least one first catch may be provided with resilient means arranged to hold each first catch in contact with said spindle means on the first roll. The first catch may be mounted on a pivot joint attached to the dispenser and/or the second sensor means.

Alternatively the same resilient means may be used for both the first sensor means and an adjacent first catch. In this case, a resilient means may be arranged to act on the at least one first catch, wherein the first catch is arranged to act on the at least one first sensor means to hold it in contact with an end surface of the first roll.

The first sensor means may comprise a single sensor on either side of the roll or one sensor on both sides. When a first sensor is located in an active position against the end surface of the first roll, the biasing force on said first sensor may also allow it to act as a brake on the first roll to prevent excessive amounts of web to be dispensed.

The second sensor means may be mounted on a pivot joint substantially parallel to an end surface of the first roll. When a first roll is located in the dispensing position a section of the at least one second sensor means remote from the pivot joint is arranged to be pivoted into a position adjacent said end surface of the first roll. According to a preferred example, the second sensor may be pivoted towards the centre of the dispenser as it is moved out of contact with the end surface of the second roll and/or the spindle means of the second roll. According to an alternative example, the said second sensor means may be provided with a guide slot having a varying depth, allowing the spindle means extending out of the end surfaces of the roll to pass into the guide slot. As the depth of guide slot decreases, the spindle means will come into contact with and displace the second sensor means. The first roll may then continue out of the guide slot and down through guides in the dispenser into a stub roll position, where it is subsequently exhausted. The spindle means may be retained until the dispenser is opened. The second sensor means and the second catch may also be arranged on a lever arm. Such a lever arm may comprise the second sensor arm located at a first end of the lever arm and a second catch located at a second end of the lever arm. The lever arm may be arranged to be actuated by losing contact with an end surface of the first roll or a spindle means of the first roll after the roll has been displaced out of the dispensing position. When actuated, the second catch at the second end of the lever arm may be arranged to be pivoted out of contact with at least one spindle means of the second roll in order to release the second roll from the reserve position. As described above, the second catch may alternatively support the second roll directly. The second roll may the move downwards through guides in the dispenser or in an upper part of the sensor itself into the dispensing position.

The second sensor means may preferably, but not necessarily, comprise a single sensor on one side of the first roll. Also, the first sensor means may be pivotably mounted on the second sensor means, wherein the pivot joint of the first sensor may be mounted on the adjacent side of the second sensor facing the first roll. According to one example, the pivot joint of the first sensor is mounted adjacent the pivot joint of the second sensor, preferably between the pivot joint of the second sensor and the part of the second sensor arranged to contact the first roll. Alternatively, the first sensor means and the second sensor means may be mounted on a common pivot axis.

In operation, the roll change is carried out sequentially in a number of consecutive steps. Each step is initiated by the user applying a force to the web in order to dispense a length of web from the dispenser. After initiating one or more of said steps the user may also assist in moving a roll through guides in the dispenser and into a dispensing position. In this context the stub roll position may technically be defined as a dispensing position, although the term "stub roll position" is used to distinguish it from the normal dispensing position. First, a pair of spring loaded, roll change initiating, first sensors will start to move when the first roll has been reduced to a certain pre-determined diameter. The sensor movement will cause a pair of first catches supporting the first roll in the dispensing position in the dispenser to be moved out of contact with their spindle means, or roll support adapter. The first roll still has a small amount of paper left and under the influence of gravity and/or the user pulling the paper, the roll will move through guides in the dispenser to a stub roll position. In the stub roll position the paper will be removed until the roll is completely exhausted. When the roll moves towards the stub roll position a second spring loaded sensor will be actuated. Actuation of the second sensor will cause a second catch to release the second roll from the reserve position. When released, the second roll will move through guides in the dispenser under the influence of gravity to take its place in the dispensing position. In order to control the movement of the rolls through the dispenser, at least one of the above-mentioned guides may be provided with a substantially vertical first section, to ensure that the respective rolls will move downwards when released. Following the vertical section, the guides may be provided with an angled second section at an enclosed angle selected within the interval 130-180° with the vertical section. The angled second section allows a degree of control of the speed of the displaced rolls, which speed can be adjusted by selecting a suitable angle for the second section. The two angled guide sections may of course have identical or different angles and the transition between the first and second sections is preferably, but not necessarily, rounded. Alternatively, one or both guides may comprise a single vertical or angled section. By controlling the speed of the rolls the roll change can be carried out without creating excessive noise when a roll reaches its intended position. As the second roll moves into the dispensing position, the end surfaces of the roll will simultaneously displace the first sensors outwards against a spring load into contact with the respective end surfaces of the second roll and move the first catches into contact with their respective spindle means. The second roll will thereby be rotatably secured in the dispensing position. The sensors and catches are then reset for a subsequent roll change, which may be carried out a once a new reserve roll has been placed in the dispenser.

In this way paper is always available on the first roll during the roll change. The relatively small first roll needs to be moved away from the regular dispensing position to leave space for the new second roll, allowing it to drop into position. The first roll may be moved to its stub roll position by gravity, by pull force from paper that is removed by a user, or by a combination of both. To ensure that the first roll is correctly located in the stub roll position, the second roll may push the first roll into the stub roll position just before reaching its dispensing position. When this occurs, sufficient inertia may be transferred to the stub roll to push it into the sub roll position. At the same time, the speed of the second roll is reduced, resulting in a relatively soft landing of the new roll in the dispensing position.

BRIEF DESCRIPTION OF DRAWINGS

In the following text, the invention will be described in detail with reference to the attached drawings. These schematic drawings are used for illustration only and do not in any way limit the scope of the invention. In the drawings.

EMBODIMENTS OF THE INVENTION

Figure 1:
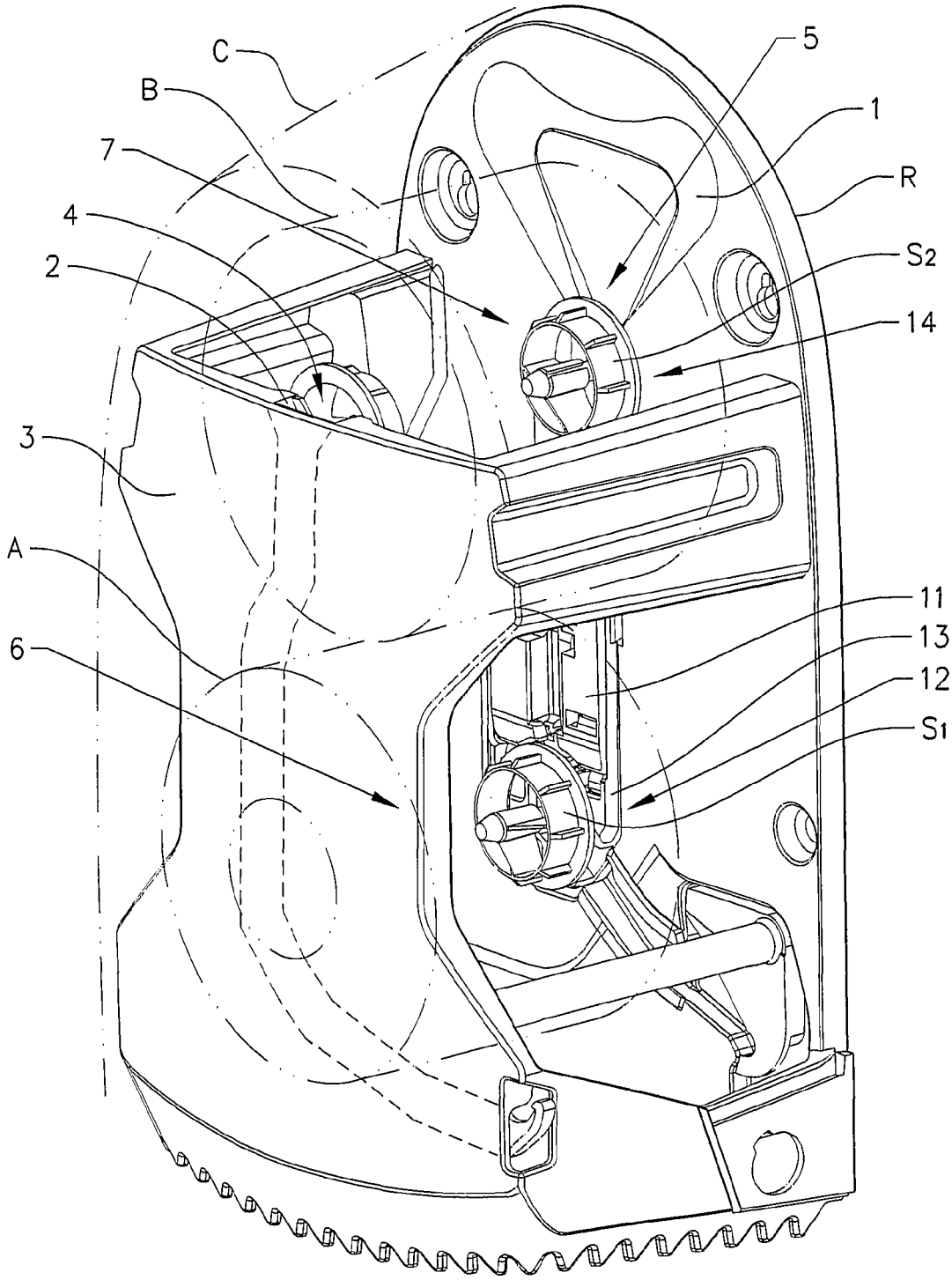
FIG. 1 shows a schematic chassis for a wall mounted dispenser according to the invention.

FIG. 1 show a schematic chassis for a wall mounted dispenser according to the invention. In the figure, an outer cover C surrounding the front and sides of the dispenser has been removed for clarity and is indicated with dash-dotted lines only. In the subsequent text the terms "inner" and "outer" are used to denote the position of components in relation to a rear section R, unless otherwise indicated. The rear section R is intended to be mounted on a wall or a similar vertical or near vertical surface. In the examples described below, the rolls are placed in the dispenser with their axes at substantially right angles to the rear section R of the wall mounted dispenser. The dispenser in this particular example can be used with any suitable type of coreless rolls, rolls with cores and solid rolls, as described above. However, the example below only describes rolls with cores having central spindle means $S_1$, $S_2$ inserted into the ends of the roll and extending axially outwardly beyond the ends of the roll.

The dispenser is arranged for receiving two rolls A, B which are inserted at the top of the dispenser by locating the spindle means in relation to converging guide surfaces 1, 2 in the rear section R and a frame 3 mounted onto the rear section and extending outwards to substantially envelop the rolls A, B at the front of the dispenser. The frame 3 is open at the top to allow inserting of rolls and open at the bottom to allow removal of web material. Guide slots 4, 5 are provided adjacent the rear section R and the inner surface of the frame 3, respectively, to guide the rolls A, B down through the dispenser into a dispensing position 6 and a reserve position 7.

Figure 2:
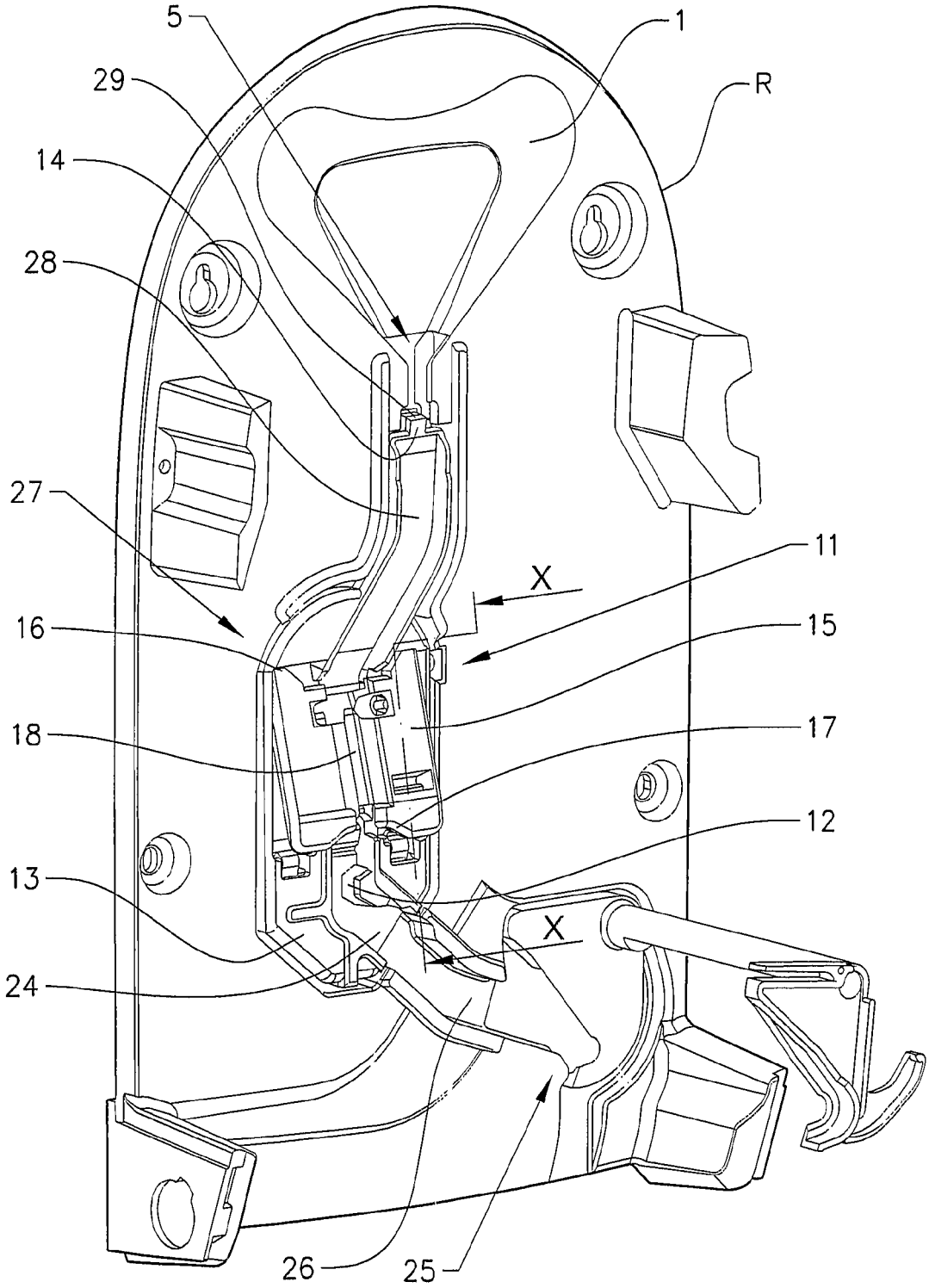
FIG. 2 shows a perspective view of the rear section R in FIG. 1.

FIG. 2 shows a perspective view of the rear section R in FIG. 1, wherein the frame 3 has been removed for clarity. The dispenser is provided with an automatic roll changing mechanism comprising a first sensor means 11 for determining that a first roll A located in a dispensing position (see FIG. 1) is nearly exhausted, a first catch 12 for supporting the first roll in a dispensing position, a second sensor means 13 for determining that the first roll has been released from the dispensing position, and a second catch 14 for supporting a second roll B in a reserve position (see FIG. 1). In the dispenser shown in FIGS. 1 and 2, identical first sensors and first catches are located on both sides of the first roll A. The second sensor and the second catch are preferably, but not necessarily, provided on one side only. The roll changing mechanism will be described in detail in connection with FIGS. 4 and 5 below.

In the rear section R, the first sensor means 11 comprises a substantially flat plate 15 located substantially parallel to an end surface of the first roll in the dispensing position. The plate 15 is provided with a pivot joint 16 at its upper end and a cut-out section 17 at its opposite, lower end. The cut-out section 17 is shaped to conform to a circular cross-section taken at right angles to the central axis of a roll having a predetermined diameter. The shape of the cut-out section may be any suitable shape, such a curved or angular shape that substantially conforms to a section of the outer periphery of a roll having said predetermined diameter. The plate 15 is also provided with a central guide slot 18 in a substantially vertical plane through the plate 15, which guide slot 18 is arranged to allow a spindle means located in the core of a roll to pass through the plate 15 towards the dispensing position. The lower end of the plate 15 is spring loaded towards the end surface of the roll, so that it will be forced into contact with the end surfaces of a roll located in the dispensing position. A contact surface is provided on the lower end of the plate 15 on either side of the guide slot 18. The contact surfaces will be parallel to the end surface of the roll when the plate 15 is in its active position and will provide a braking force to prevent an uncontrolled dispensing of the first roll. When the first roll is reduced to the said predetermined diameter the cut-out section 17 will lose contact with the end surface of the roll and the plate 15 will be pivoted outwards, as shown in FIG. 2. The plate 15 is spring loaded by spring means acting on the first catch 12 located below the plate 15 to the side of the first roll A. The first catch 12 is arranged for releasably supporting the first spindle means $S_1$ (see FIG. 1) of the rotatable first roll in the dispensing position.

Figure 3:
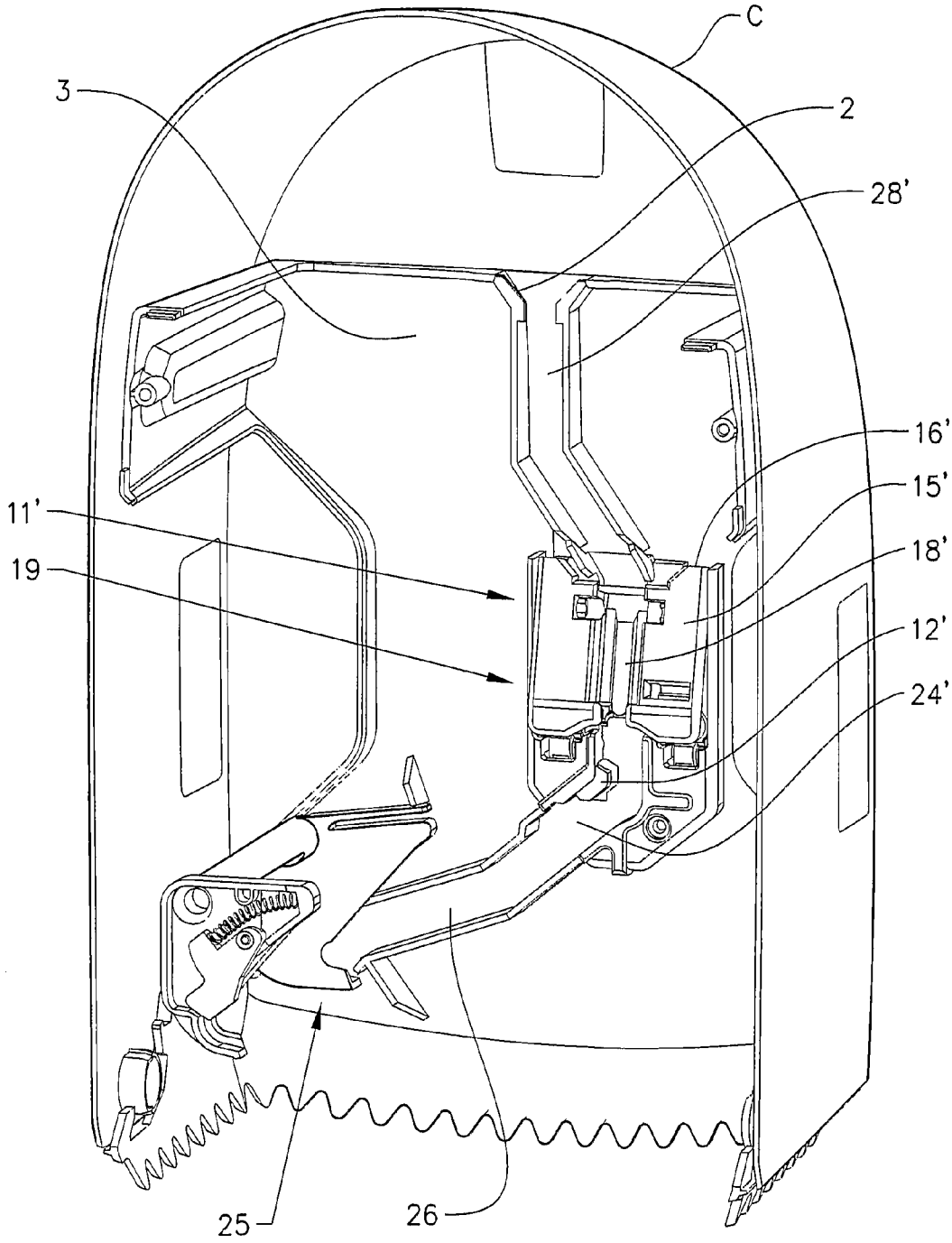
FIG. 3 shows a perspective view of the rear of the cover in FIG. 1.

FIG. 3 shows a perspective view of the rear of the cover indicated in FIG. 1, including the inner surface of the frame 3. Many components located on the rear section R and the frame 3, respectively, are substantially identical and perform the same function. In the subsequent text, such components located in the frame 3 will be identified using the same reference number provided with an apostrophe. In the frame 3, the first sensor means 11' comprises a substantially flat plate 15' located substantially parallel to an end surface of the first roll in the dispensing position. The plate 15' is provided with a pivot joint 16' at its upper end and a cut-out section 17' at its opposite, lower end. The plate 15' is also provided with a central guide slot 18' in a substantially vertical plane through the plate 15'. The plate 15' is spring loaded by spring means acting on the first catch 12' located below the plate 15' to the side of the first roll A.

Figure 4A:
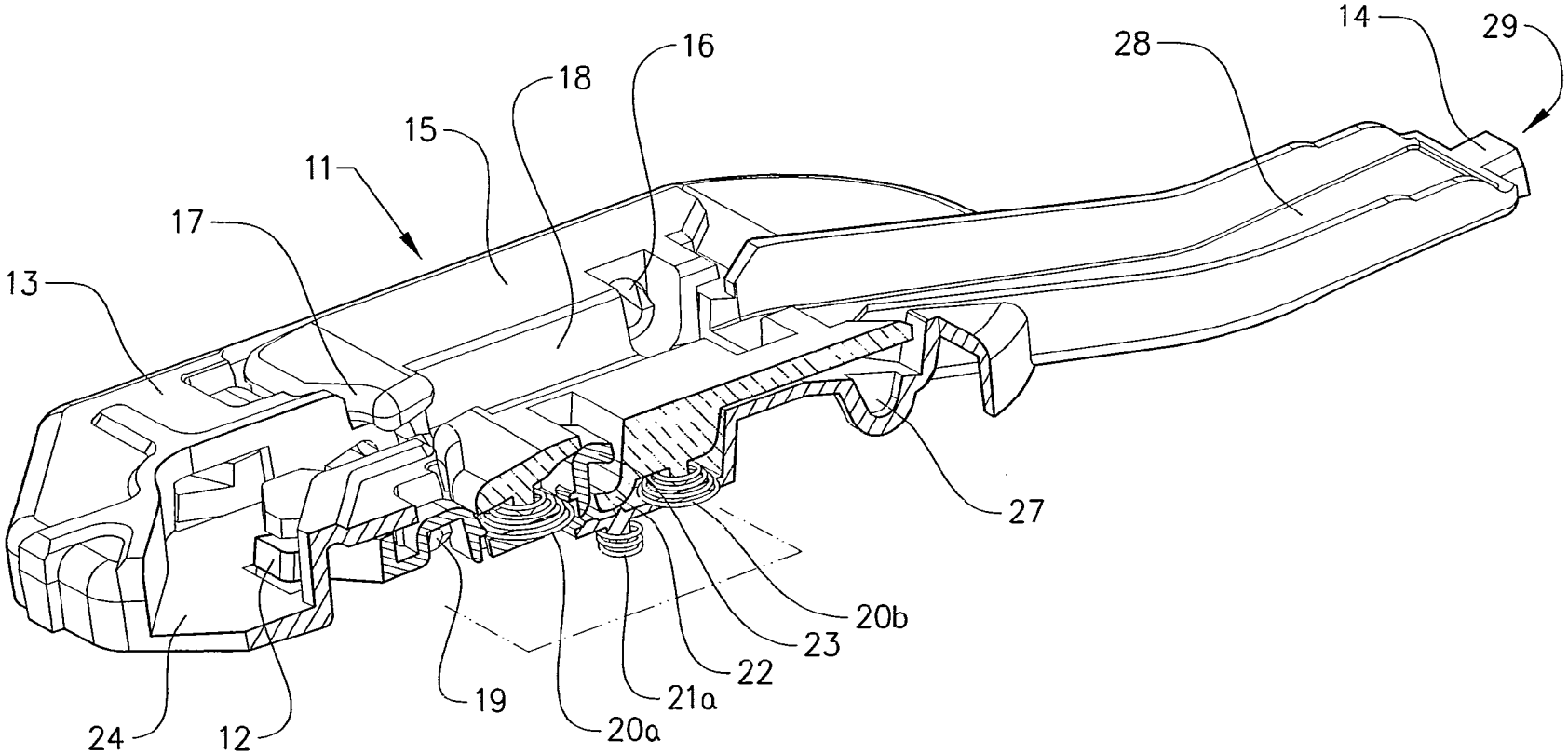
FIG. 4*a* shows a perspective view of a roll changing mechanism in a first position.

FIG. 4*a* shows a perspective view of a roll changing mechanism according to the invention. The figure shows a partial cross-section of the mechanism along the section X-X in FIG. 2. The mechanism shown is located in the rear section R of the dispenser. As described above, the mechanism comprises a first sensor means 11 for determining that a first roll A located in the dispensing position (see FIG. 1) is nearly exhausted, a first catch 12 for supporting the first roll in the dispensing position, a second sensor means 13 for determining that the first roll has been released from the dispensing position, and a second catch 14 for supporting a second roll B in the reserve position. As can be seen from FIG. 4*a*, the first sensor means 11 with its plate 15 and the first catch 12 are mounted on the second sensor means 13, which in turn is rigidly joined to the second catch 14. The plate 15 is located in a recess in the first sensor means 13 so that its outer surface is substantially flush with the surface of the second sensor means 13 when in contact with the end surface of a roll. This is shown in FIG. 1, in which it can also be seen that the second sensor means 13 is located in a recess in the rear section R so that its outer surface is substantially flush with the surface of the rear section facing a roll. The first catch 12 is pivotably mounted on a pivot joint 19 in the rear section R.

Figure 4B:
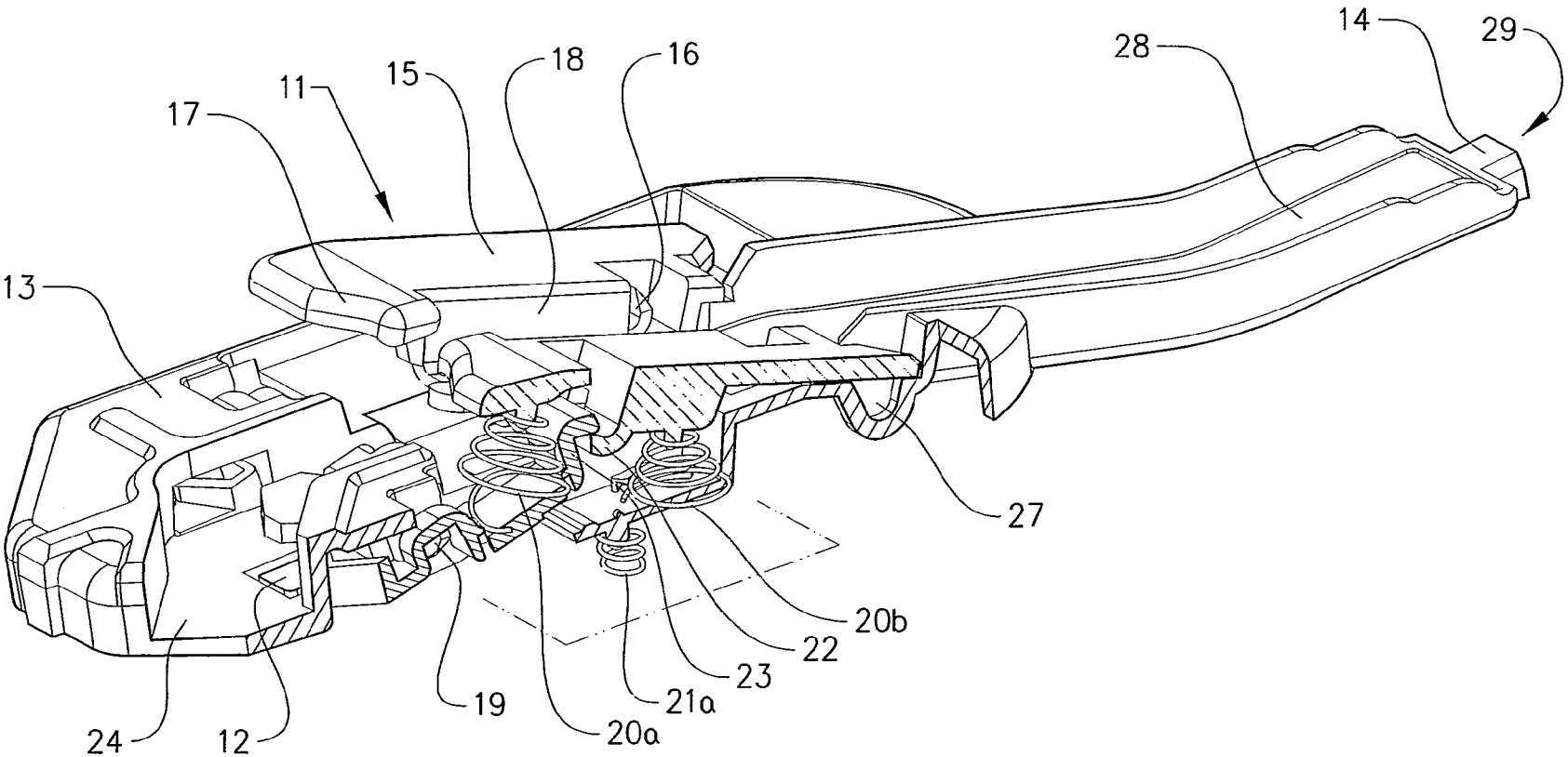
FIG. 4*b* shows a perspective view of a roll changing mechanism in a second position.

A first spring 20*a* is mounted between the first catch 12 and the plate 15, in order to spring load the plate 15 of the first sensor means 11 towards the end surface of a roll in the dispensing position. The first spring 20*a* will also hold the first catch 12 in its active position, supporting the first roll in the dispensing position. When the diameter of the roll is reduced to a predetermined diameter the cut-out section 17 of the plate 15 will move out of contact with an end surface of a roll in the dispensing position, whereby the plate 15 is displaced past the plane of the end surface of the roll, as shown in FIG. 4*b*. A second spring 20*b* is mounted in the recess between the second sensor means 13 and the plate 15 to assist the displacement of the plate 15 and to maintain it in the displaced position. During this movement, a projection 22 extending from the rear surface of the plate 15 is arranged to interact with a corresponding projection 23 at an end section of the first catch 12 to pivot the first catch 12 out of contact with a spindle means in the roll. The roll is then released down through a guide channel 24 at the lower end of the second sensor means 13. The interacting projections 22, 23 also act as a stop to limit the angular displacement of the plate 15. A similar arrangement for the plate 15' located in the frame 3 is shown in FIG. 3.

The main difference between the inner and outer first sensor means 11, 11' and the inner and outer first catch 12, 12' is that the components mounted in the frame 3 are located in a recess in the inner surface of the frame 3, and that the first spring 20*a*' is located between the frame 3 and the plate 15'. Similarly, the first catch 12' is located in a guide channel 24' in the frame 3. The function of the inner and outer first sensor means 11, 11' and the inner and outer first catch 12,12' is the same.

Triggering of the first sensor means 11, 11' by the displacement of the plate 15, 15' into the position shown in FIG. 4*b* will simultaneously cause the first catch 12, 12' to be pivoted out of the guide channel 24, 24' in the second sensor means 13 and the frame 3 respectively. When the inner and outer catches 12 supporting the roll spindles are withdrawn, the roll will begin to drop downwards from the dispensing position, either under the influence of gravity, or by a user pulling the end of the web, towards a stub roll position 25. During this movement, the roll spindles of the first roll will initially pass through the guide channels 24, 24' below the respective first sensor means 11, 11'. Subsequently the roll spindles will pass into a pair of lower guide slots 26, 26' in the rear section R and the frame 3 respectively. The lower guide slots 26, 26' lead down to the stub roll position 25 located below and to one side of the dispensing position. The second sensor means 13 and its guide channel 24 are held in contact with an end surface of the inner spindle of the roll. The downward movement of the roll will eventually cause the spindle to exit the guide channel 24 in the second sensor means 13 and enter the adjacent lower guide slot 26. The guide channel 24 will then lose contact with the end of the spindle and the lower end of the second sensor means 13 will be deflected towards the end surface of the roll as the sensor 13 is pivoted about a pivot joint 27 under the force of a pair of springs 21*a*, 21*b*. The springs 21*a*, 21*b* are located between the second sensor means 13 and the rear section R. The pivot joint 27 is arranged to retain the second sensor means 13 in the recess in the rear section R. The pivoting movement of the second sensor means 13 will trigger the second catch 14.

The second catch 14 is an integrated part of the second sensor means 13 and has an upper support surface 29 arranged to support the inner spindle $S_2$ of the second roll B in the reserve position (see FIG. 1). The second catch 14 is located at the upper end of an upper guide slot 28 above the inner first sensor means 11 adjacent the rear section R of the dispenser. In this example, the upper guide slot 28 is an integrated part of the second sensor means 13 and is arranged to extend upwards from the pivot joint 27. The upper support surface 29 is located at the upper end of said guide slot 28. A corresponding upper guide slot 28' is located in the frame 3 above the outer first sensor means 11'. The guide slots 28, 28' are arranged to cooperate with spindle means at the ends of a roll and are open at the top to allow rolls to be inserted from above into the dispenser. Both upper guide slots 28, 28' lead down to the central guide slots 18, 18' of the plates 15, 15' in the first sensor means 11, 11'. When the second sensor means 13 is triggered, its lower end is pivoted outwards, in the direction of the inner end surface of the first roll. The pivoting outward movement of the lower end causes a simultaneous inward movement of the support surface 29, bringing it out of contact with the inner spindle $S_2$ of the second roll B (see FIG. 1). The second roll will then drop from its reserve position, through the upper guide slots 28, 28' and down towards the dispensing position, in order to complete an automatic roll change operation.

Figure 5:
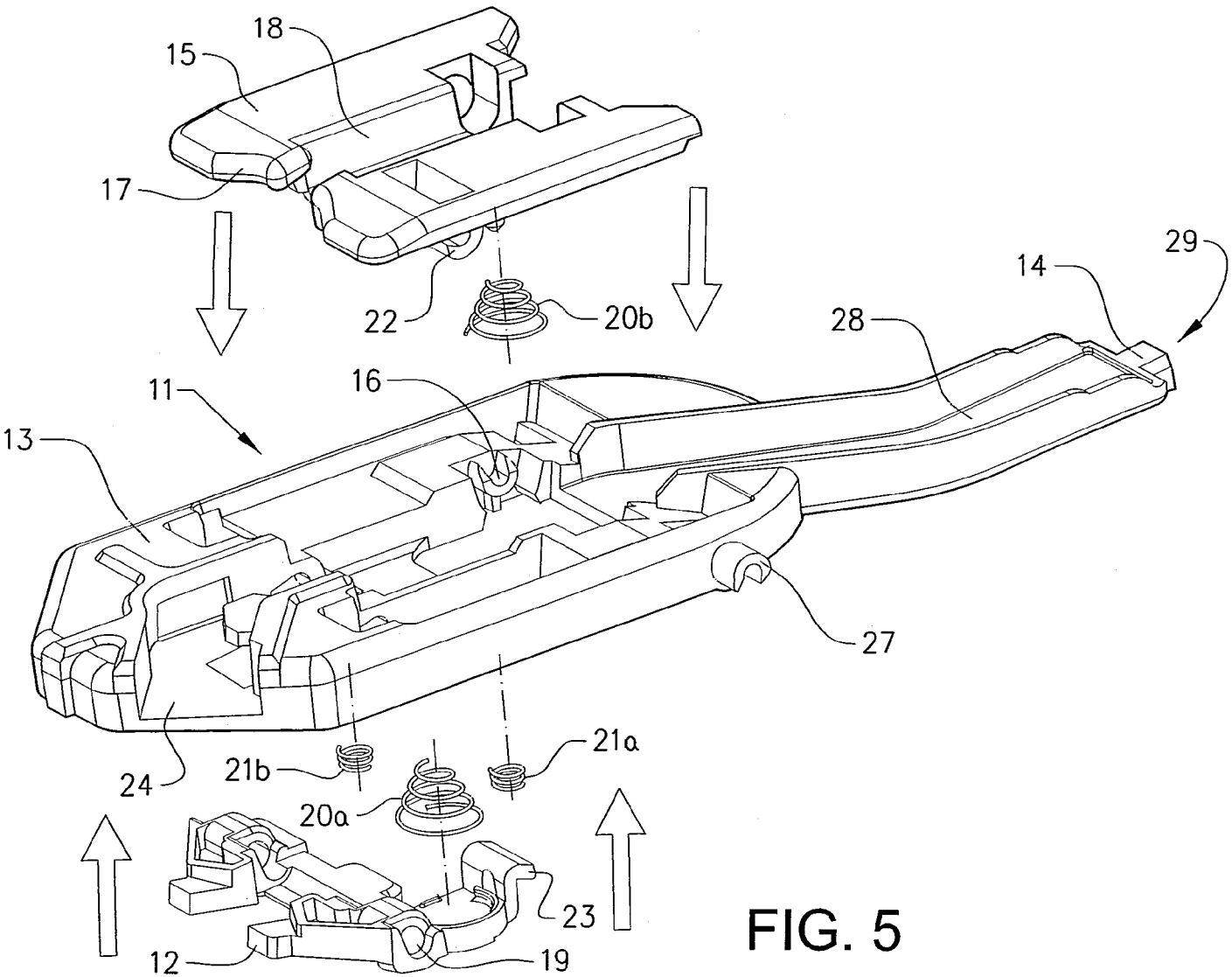
FIG. 5 shows an exploded view of the roll changing mechanism in FIG. 4*a*.

FIG. 5 shows an exploded view of the roll changing mechanism described in connection with FIG. 4*a*. The figure shows how the plate 15 of the first sensor means and the intermediately positioned first spring 20*a* are located in a recess in an outer surface of the second sensor means 13. Also, the first catch 12 for supporting the first roll in the dispensing position and the intermediately positioned second spring 20*b* are located in a recess in an inner surface of the second sensor means 13. The springs 21*a*, 21*b* located between the second sensor means 13 and the rear section R (not shown) are also in contact with the inner surface of the second sensor means 13.

The mechanism shown in FIGS. 4*a*-*b* and 5 is described as being located in the rear section R only, but it may also be mounted in the frame 3 or in both the rear section and the frame.

Figure 6:
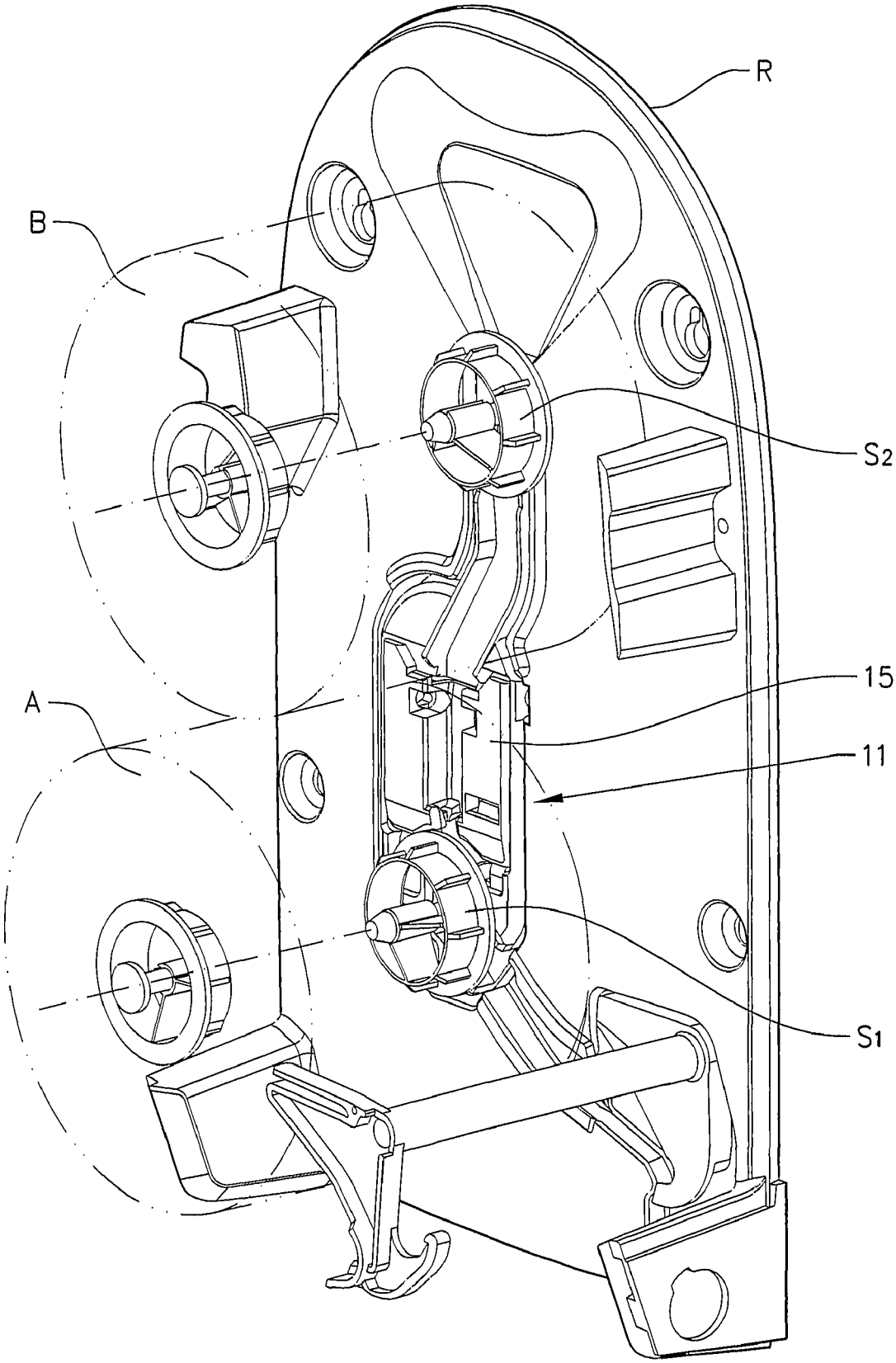
FIG. 6-9 show the steps involved in an automatic roll change operation.

FIGS. 6-9 show the steps involved in an automatic roll change operation. The steps are described in relation to the mechanism mounted in the rear section R of the dispenser. FIG. 6 shows a roll dispenser provided with a first roll A located in the dispensing position and a second roll B located in the reserve position. The first roll A is held in place by the first catch 12 and the second roll B is held in place by the second catch 14 (see FIG. 2). The plate 15 of the first sensor means 11 is spring loaded into contact with the end surface of the first roll A.

Figure 7:
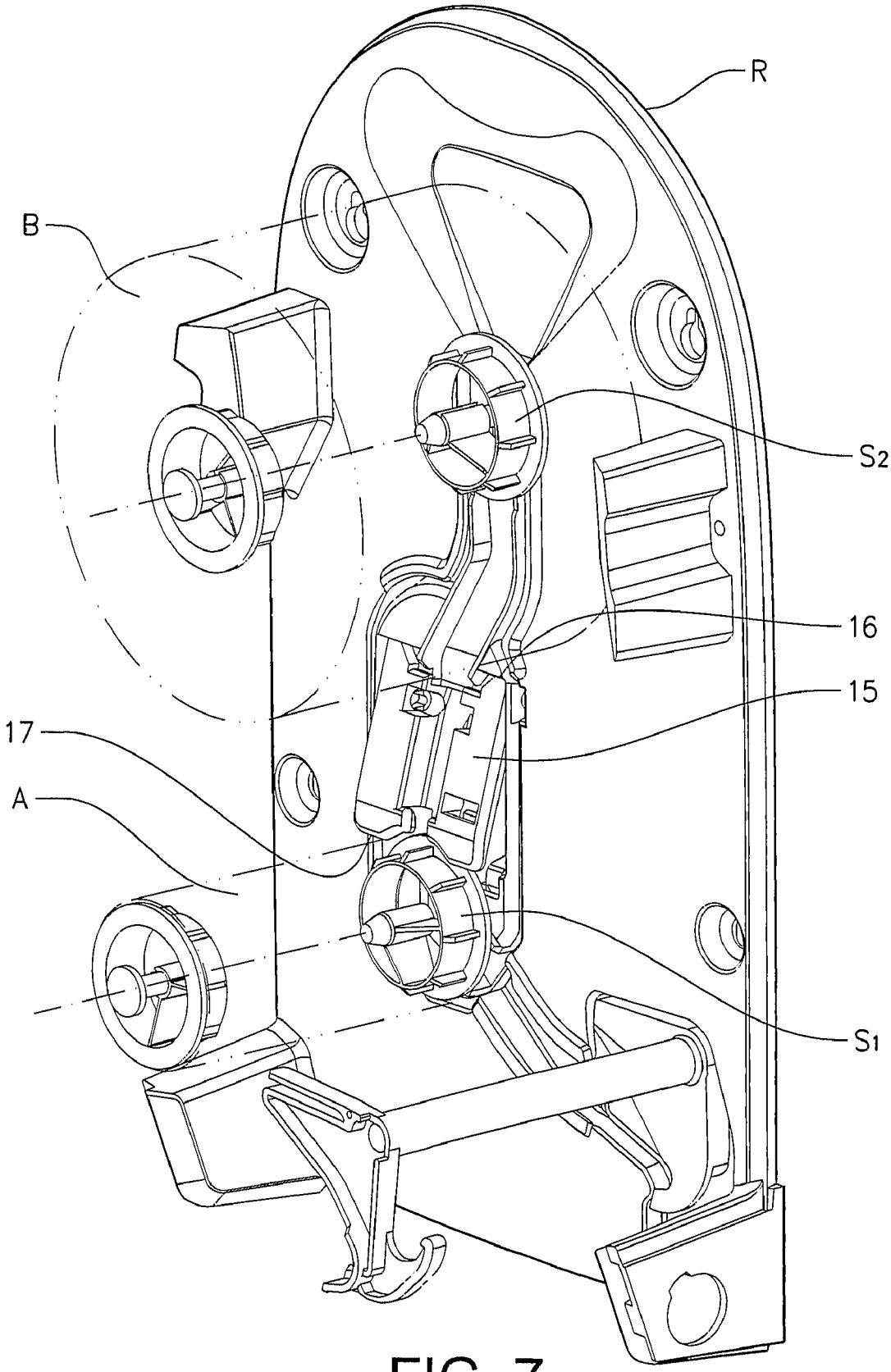

FIG. 7 shows the dispenser during a first phase of a roll shift operation. The diameter of the first roll A has been reduced below a predetermined size, whereby the plate 15 has lost contact with the end surface of the first roll A. This has caused the plates 15 to pivot about its pivot joint 16 so that the cut-out end section 17 has been displaced past the plane of the end surface of the first roll A under the force of the springs 20*a*, 20*b* acting on the plate 15 and the first catch 12 (see FIG. 4*a*). The displacement of the plate 15 causes a simultaneous retraction of the first catch 12 supporting the spindle $S_1$ of the first roll A. This will cause the first roll A to move downwards in the guide channel 24 and will subsequently cause the second sensor means 13 to be triggered.

Figure 8:
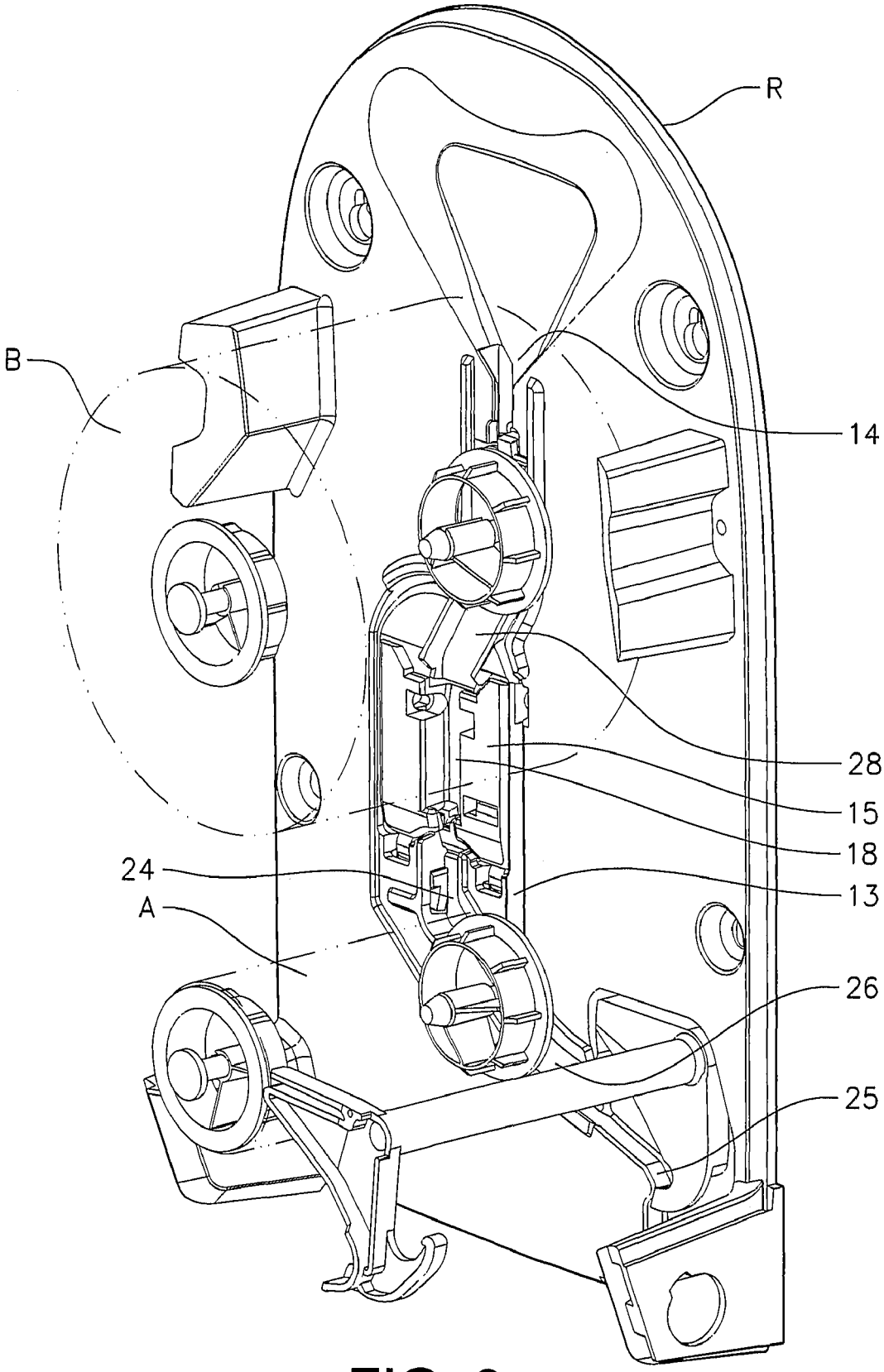

FIG. 8 shows the dispenser during a second phase of a roll shift operation. The nearly exhausted first roll A has entered the lower guide slot 26 and is on its way towards the stub roll position 25. This has caused the second sensor means 13 to be triggered to release the second catch 14. The second roll B has been released from the reserve position by the triggering of the second sensor means 13 and is moving down the upper guide slot 28 towards the dispensing position. The inner end surface of the second roll B has contacted and pivoted the plate 15 into its recess in the second sensor means 13 in order to reset the roll change mechanism.

Figure 9:
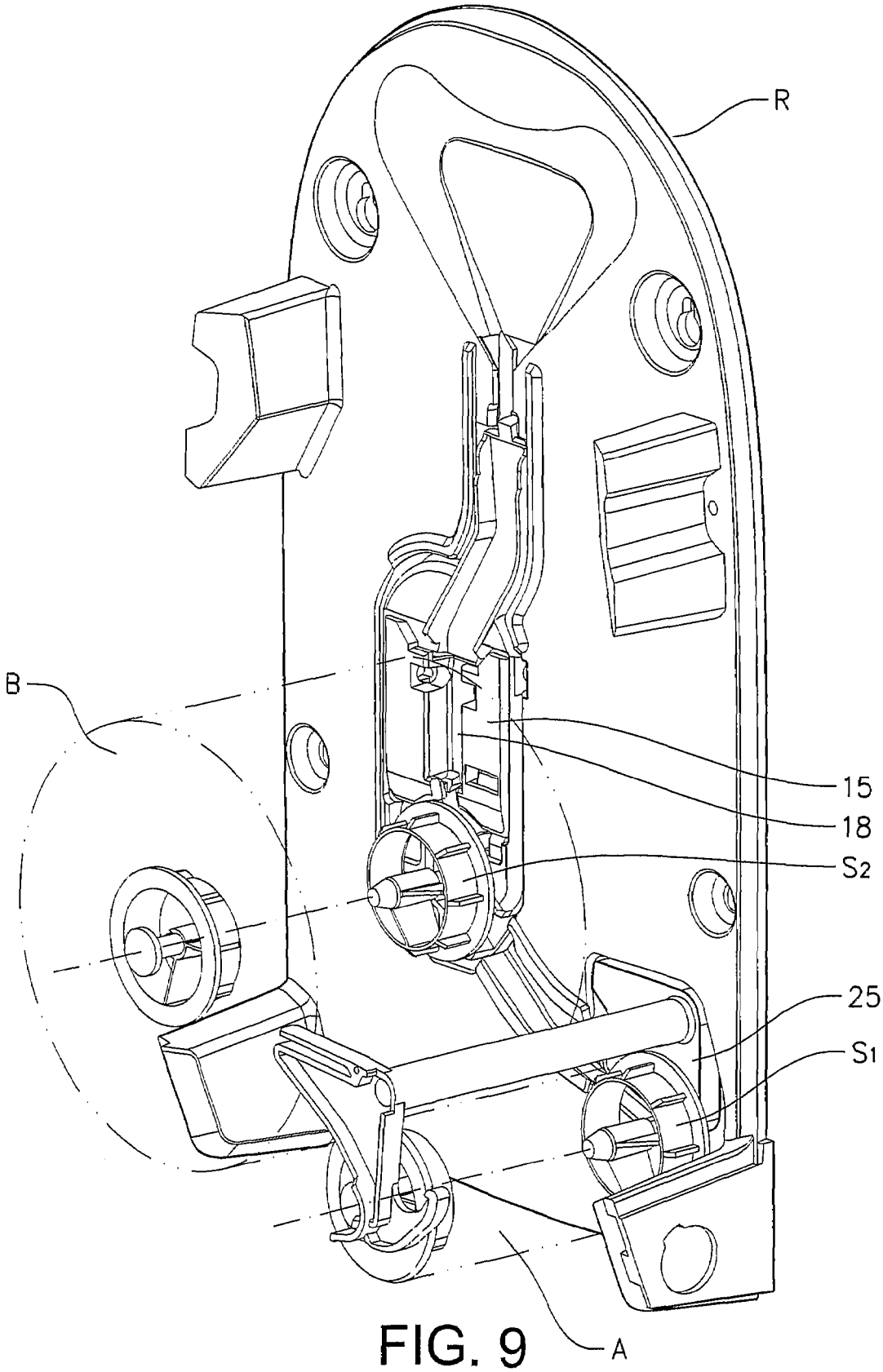

FIG. 9 shows the dispenser after a completed roll shift operation. The nearly exhausted first roll A has entered stub roll position 25. The second roll B has passed the central guide slot 18 in the plate 15 and has reset the first catch 12 (see FIG. 2) supporting said second roll in the dispensing position. The first roll A will eventually be completely exhausted in the stub roll position 25, where after a user may grasp the end of the web of the second roll B in the dispensing position. The spindles of the exhausted first roll A will be retained in the stub roll position until the dispenser cover is removed to refill the dispenser.

The invention is not limited to the above embodiments, but may be varied freely within the scope of the appended claims. For example, the spindle means may comprise any suitable type of plug or adapter inserted into or adhesively attached to the ends of a roll core, a coreless roll or a solid roll. The pairs of plugs or adapters may be individual units or be joined through the centre of a roll.

The invention claimed is:

1. A method for dispensing rolls of flexible sheet material, each of said rolls having spindle means extending axially outwardly beyond the ends thereof, wherein a first roll is in a dispensing position and a second roll is in a reserve position above said dispensing position, said method comprising the steps of:

sensing the diameter of the first roll via at least one first sensor means in contact with at least a planar portion of an end surface of the roll, triggering movement of said at least one first sensor means when the diameter is below a predetermined value, whereby the first sensor means is no longer in contact with the least least planar portion of the end surface of the first roll and is displaced past the plane of the end surface of the first roll, releasing at least one first catch holding the first roll in place, said at least one first catch holding the first roll in place by contact with a center end portion of the first roll, said at least one first catch being released by the displacement of said at least one first sensor means interacting with said at least one first catch, allowing the first roll to move out of the dispensing position for subsequent actuation of at least one second sensor means by the end surface of the first roll contacting with said at least one second 'sensor means, releasing at least one second catch holding the second roll in the reserve position, said at least one second catch being released by the movement of the first roll out of the dispensing position, and allowing the second roll to move from the reserve position into the dispensing position.

2. The method according to claim 1, further comprising holding the at least one first sensor means in contact with an end surface of the roll by pivoting a section of the first sensor means into contact with said end surface.

3. The method according to claim 1, further comprising holding the at least one first sensor means in contact with an end surface of the roll by using resilient means acting on the at least one first catch.

4. The method according to claim 1, further comprising simultaneously actuating said at least one second sensor means and releasing the second catch by moving second sensor means towards an end surface of the first roll and moving the second catch out of contact with said second roll.

5. The method according to claim 1, further comprising allowing the first roll to move from the dispensing position to a stub roll position.

6. A dispenser for rolls of flexible sheet material, each of said rolls having spindle means extending axially outwardly beyond the ends thereof, wherein a first roll is located in a dispensing position and a second roll is located in a reserve position above said dispensing position, wherein the dispenser comprises:

at least one first sensor means arranged for sensing the diameter of the first roll, which at least one first sensor means is in contact with at least a planar portion of an end surface of the roll, and said at least one first sensor means is displaceable between a first position in contact with said planar portion of said end surface and a second position not in contact with the end surface of the first roll and past the plane of the end surface when the diameter of the first roll is below a predetermined value, at least one first catch holding the first roll in place by contact with a center end portion of the first roll, said at least one first catch is arranged to be released by the displacement of said at least one first sensor means interacting with said at least one first catch, at least one second sensor means contacting with the end surface of the first roll for determining that the first roll has been released from the dispensing position, said at least one second sensor means displaceable between a first position and a second position by the first roll when the first roll is displaced out of the dispensing position, and at least one second catch holding the second roll in place arranged to be released by the displacement of said at least one second sensor means.

7. The dispenser according to claim 6, wherein the at least one first sensor means is mounted on a pivot joint substantially parallel to an end surface of the first roll.

8. The dispenser according to claim 7, wherein a section of the first sensor means remote from the pivot joint is arranged to be pivoted into contact with said end surface.

9. The dispenser according to claim 8, wherein the at least one first sensor means is provided with resilient means arranged to hold each first sensor means in contact with said end surface.

10. The dispenser according to claim 6, wherein the at least one first catch is provided with resilient means arranged to hold each first catch in contact with said spindle means on the first roll.

11. The dispenser according to claim 6, wherein the at least one first sensor means is in contact with an end surface of the roll by using resilient means acting on the at least one first catch.

12. The dispenser according to claim 6, wherein the first sensor means comprises one sensor on both sides of the roll.

13. The dispenser according to claim 6, wherein the second sensor means is mounted on a pivot joint substantially parallel to an end surface of the first roll.

14. The dispenser according to claim 13, wherein the second sensor means and the second catch are arranged on a lever arm.

15. The dispenser according to claim 14, wherein the lever arm is arranged to be pivoted out of contact with the first roll after the roll is displaced out of the dispensing position.

16. The dispenser according to claim 15, wherein the lever arm is arranged to be pivotable out of contact with the second roll.

17. The dispenser according to claim 6, wherein the second sensor means comprises a single sensor on one side of the roll.

18. The dispenser according to claim 6, wherein the first sensor means is mounted on the second sensor means.

19. The dispenser according to claim 6, wherein the first sensor means and the second sensor means are mounted on a single pivot axis.

* * * * *